United States Patent [19]

Gordon

[11] Patent Number: 4,463,847

[45] Date of Patent: Aug. 7, 1984

[54] RUST-PREVENTIVE FIREARMS RECEPTACLE

[75] Inventor: Stuart P. Gordon, Raleigh, N.C.

[73] Assignee: The Bob Allen Companies, Inc., Des Moines, Iowa

[21] Appl. No.: 435,084

[22] Filed: Feb. 1, 1983

[51] Int. Cl.[3] ..... B65D 81/24; B65D 85/00

[52] U.S. Cl. ..... 206/205; 206/317; 206/524.3; 224/911; 224/913

[58] Field of Search ..... 206/205, 317, 524.3, 206/524.8; 224/911, 913

[56] References Cited

U.S. PATENT DOCUMENTS 2,914,377 11/1959 Bull ..... 206/205

3,410,392 11/1968 Hermanson ..... 206/205

FOREIGN PATENT DOCUMENTS 961813 1/1975 Canada ..... 206/317

*Primary Examiner*—William T. Dixson, Jr.

*Attorney, Agent, or Firm*—Henderson & Sturm

[57] ABSTRACT

A rust-preventive firearm receptacle comprising a water-vapor-impervious material cover defining a cavity, a vapor-phase anti-rust inhibitor insert with active vapor-phase anti-rust inhibitor, a soft interior, including a pocket attached to the interior for replaceably receiving the insert, and a tape device mounted about the perimeter of the receptacle to seal the interior cavity thereof from outside air. The invention is generally used by placing a chemical carrier insert into the cavity pocket such that when the firearm is carried within the sealed cavity of the receptacle, it is surrounded by the vapor-phase inhibitor emanating out of the insert. When inactive, the insert can be replaced.

2 Claims, 5 Drawing Figures

RUST-PREVENTIVE FIREARMS RECEPTACLE

FIELD OF THE INVENTION

This invention relates to firearms receptacles, and more particularly to improved protective receptacles for preventing mechanical or corrosive damage to a firearm stored therein, or unauthorized tampering or use of the firearm.

CROSS-REFERENCE TO RELATED APPLICATIONS

There are no related applications at this time.

PRIOR ART

Firearms have always suffered from rust and those who work with firearms have devised numerous ways to protect them from corrosion. Guns are typically protected by a coating of bluing or other anticorrosive barrier surfaces on their metal exteriors. In ordinary use and handling, however, barrier surfaces are broken and the metal exposed to moisture in the atmosphere, whereupon rust begins at the exposed areas. Firearms are especially susceptible to rust during storage, and steps taken to prevent them in storage have been quite elaborate. Not long ago the prime method of rust prevention was to embed the firearm's metallic parts in grease.

With the development of vapor-phase inhibitors, such as Shell Oil Company's VPI 260 TM anticorrosion storage was made substantially more conveient. These chemicals are a stable nitrite of an organic amine. It acts by volatilizing and, in the vapor phase, being adsorbed on the metal surface where it forms an invisible film which prevents corrosion by passivating the metal.

The recommended application is by impreganted paper, as is described in U.S. Pat. No. 2,737,136, to D. H. Ryder, wherein a gun case includes an interior liner of a low-acid kraft paper in which crystals of the antirust substance are said to adhere to projecting paper fibers, and to be held in place by irregularities and intersticies on the paper surface.

There is a difficulty with paper liners in firearms receptacles, however, in that they tend to be abrasive against the metal finishes of firearms so that while the firearm is protected while in storage, upon being placed in use it may be subjected to accelerated corrosive activity. Additionally, paper liners lack esthetic appeal, and are thought to detract from a consumer's appreciation of a gun case as an item of high quality. Also, the paper, permanently attached to the gun case, eventually loses its chemical impregation, especially if left exposed to ambient air, so that a case which relies upon impregnated paper for its antirust agent must be regarded as disposable, and hence is not constructed for the high quality firearms receptacle market.

It is therefore an object of my invention to make a rustpreventive firearms receptacle which notonly is of high quality but is readily appreciated as such.

It is a further object of my invention to provide an antirust firearms receptacle with renewable antirust protection so that the receptacle may be regarded as a permanent storage unit for a firearm.

Another object of my invention is to provide a rugged and durable rust-preventive storage housing for a firearm.

Another object of my invention is to provide a shock-absorbent, cushioned, antirest receptacle for a firearm.

Still another object of my invention is to provide an anti-rust receptacle for a firearm with a soft inner lining to reduce any potential for wear or abrasion of the firearm while it is in the receptacle, especially while being transported.

Yet another object of my invention is to provide a more convenient and substantially airtight closure for an antirust fire-arms receptacle.

Another object of my invention is to provide means for varying the intensity of antirust chemical vapor in a firearms receptacle.

Another object of my invention is to provide means for locking an antirust firearms receptacle against casual or unintended access by children or others.

DESCRIPTION AND OPERATION OF THE INVENTION

Figure 1:
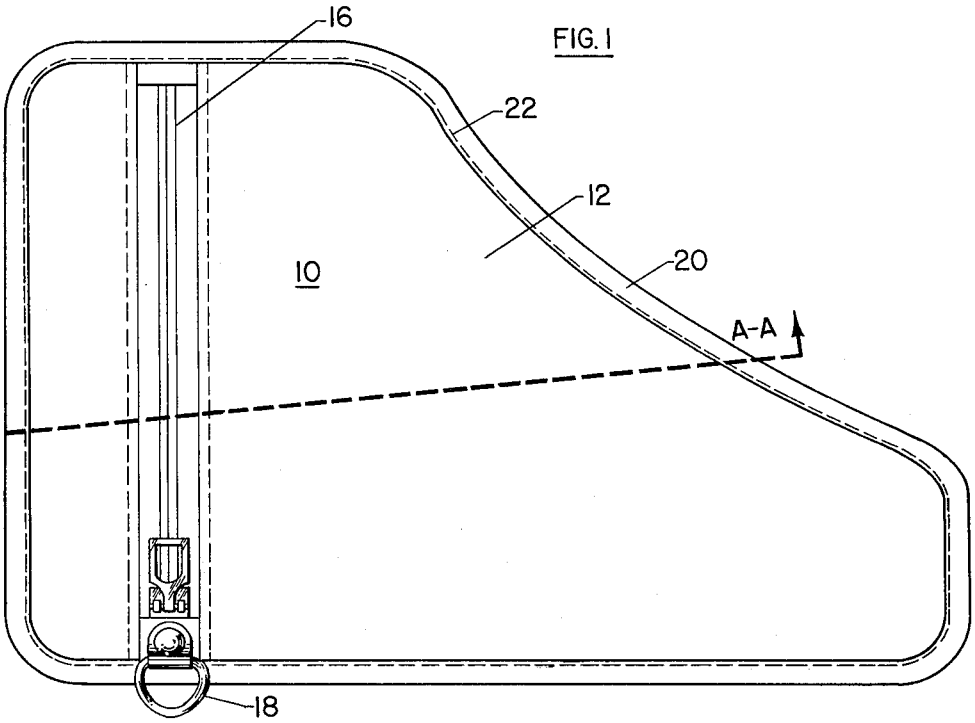
FIG. 1 is a plan view of the firearms receptacle of my invention.

A firearms receptacle 10 after my invention is shown in FIG. 1. It includes a top cover 12, a slide fastener 16, a D-ring 18, and a closure tape 20 carefully securing the top cover 12 to a bottom cover 14 by stitches 22. The material for the covers 12 and 14 is chosen for its rugged, durable character, its attractiveness, and its property of being substantially impermeable to water or water vapor. A typical material, indeed the preferred material, is a heavy vinyl which has the additionally advantageous property of being somewhat flexible to as to adapt to the contours of a firearm which may be placed in the receptacle.

Figure 2:
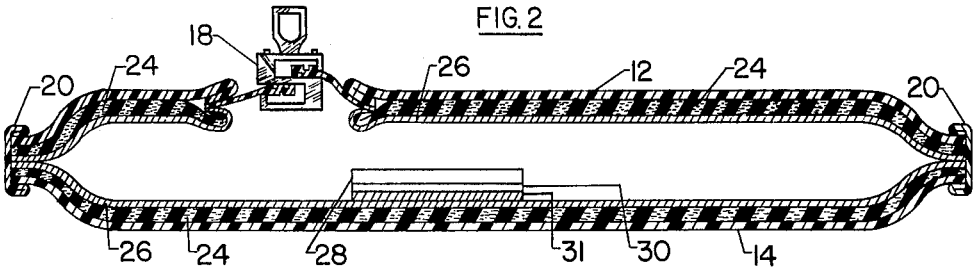
FIG. 2 is a section view along the lines A—A of FIG. 1.

The section view of FIG. 2 shows the top and bottom covers 12 and 14 underlain respectively by foam layers 24, which in turn are in contact with a relatively thick, soft cloth lining 26, such as velvet. Alternatively the covers 12 and 14 may be in contact with any deformable resilient means presenting a soft, nonabrasive surface, such a lambs' fleece or any of the artificial equivalents thereof, so as to protect the firearm from abrasion such as might be incurred when the firearms receptacle is packed in among other articles of varying shapes and textures, especially if those articles are being transported and are being frequently rubbed, bounced and shifted about by motion of the transport carrier. A chemical carrier insert 28, which has attached a portion 30 of Velcro TM fastener, is engaged with a Velcro TM base pad 31 which is affixed to the soft cloth lining 26, or otherwise to the interior of the firearms receptacle.

Figure 3:
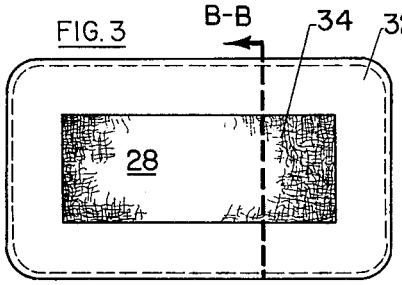
FIG. 3 is a plan view of a chemical insert package according to my invention.
Figure 4:
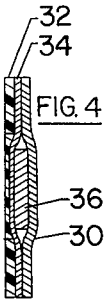
FIG. 4 is a section view along the lines B—B of FIG. 3.

The chemical insert 28, shown in FIG. 3, includes a frame 32, typically of the same material as the covers 12 and 14, but potentially of any substantial material, and a porous retainer cover 34, made of an air-breathing material such as gauze. As seen in FIGS. 3 and 4 the frame 32 and cover 34 are stitched about the periphery to a Velcro TM portion 30 so as to define an interior cavity in which is found a chemical medium 36, such as a piece of felt which has been impregnated by well-known means with an antirust inhibitor such as the Shell Oil Company's VPI 260 TM product, or other antirust inhibitor. Of course, it will be perceived that the chemical medium 36 could be no more than crystals of the antirust inhibitor itself.

The entire receptacle 10 is carefully and sealably closed about its perimeter by the closure tape 20. The tape 20, the covers 12 and 14, foam layer 24 and inner lining 26 are all stoutly secured in place by stitches 22, to define an interior cavity which may be isolated from ambient air. Access to the interior cavity for storage and retrieval of a firearm is by means of the aperture closed by the slide fastener 16, which is preferably of the extruded plastic type such as the well-known Flexigrip TM strip variety which has double pairs of engaging tracks for extra sealing potential continuously along the length of the fastener.

Figure 5:
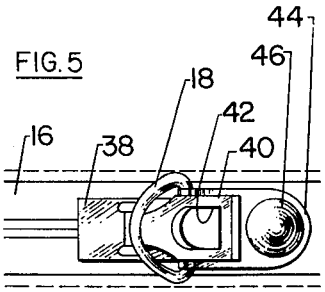
FIG. 5 is a detail view of a slide fastener used in my invention.

As seen in FIG. 5 the slide fastener 16 of my invention includes a slider 38 to which is secured a handle 40 so shaped as to be adaptable to be extended through the D-ring 18. The handle 40 is so shaped as to define, when extended through the D-ring 18, an aperture 42 at its distal end, of sufficient breadth to receive a locking device, such as a padlock of any suitable kind. The slide fastener 16 is stoutly retained against the top cover 12 by the pressure, exerted through the D-ring base 44, of the D-ring retaining rivet 46.

When the fastener 16 is so closed, it will be perceived that it, the covers 12 and 14 and the closure tape 20, define a substantially water-vapor-impermeable closure within which a firearm is surrounded by the vapor phase inhibitor emanating out of the chemical carrier insert 28 through its porous cover 34 from the impregnated felt chemical medium 36. As the inhibitor interacts with the metal surfaces of the firearm, they are passivated and protected against corrosion. As and when the strength of the chemical declines, the chemical carrier insert 28 may be discarded and replaced by a fresh one to renew the antirust potential of the firearms receptacle.

If for any reason, such as the venturing of the firearms owner into very humid conditions, it were desired to supply extra protection against corrosion in the receptacle, extra large amounts of impregnated chemical medium could be supplied. Several fresh carrier inserts 28 could be attached to the Velcro TM base pad 31 to achieve this end. Similarly, fully or partially saturating impregnation techniques could be applied to the chemical medium 36 to bring about whatever strength of antirust action might be desired.

It will be clear to those skilled in the art that many variations of my invention are possible within the spirit and scope of my invention. Accordingly, as I do not wish to be bound by the specific description of the preferred embodiment described above, the scope of the invention should be determined by the claims which follow, and their legal equivalents:

I claim:

1. a rust-preventive firearm receptacle comprising:

a water-vapor-impervious material cover defining a cavity, a vapor-phase antirust inhibitor insert with active vapor-phase antirust inhibitor, a soft interior, including means attached to said interior for replaceably receiving said vapor-phase antirust inhibitor insert, and closure means for sealably closing said cover over a firearm within said cavity.

2. The firearm receptacle of claim 1 further comprising deformably resilient cushioning means between said cover and said soft interior.

* * * * *